73-151 SR
8/23/83 OR 4,399,692

United States Patent [19]
Hulsing, II et al.

[11] 4,399,692
[45] Aug. 23, 1983

[54] BOREHOLE SURVEY APPARATUS UTILIZING ACCELEROMETERS AND PROBE JOINT MEASUREMENTS

[75] Inventors: Rand H. Hulsing, II, Redmond; Rex B. Peters, Woodinville, both of Wash.

[73] Assignee: Sundstrand Data Control Group, Redmond, Wash.

[21] Appl. No.: 224,789

[22] Filed: Jan. 13, 1981

[51] Int. Cl.[3] ..... E21B 47/00
[52] U.S. Cl. ..... 73/151; 33/313
[58] Field of Search ..... 73/151; 33/312, 313

[56] References Cited

U.S. PATENT DOCUMENTS 3,545,266 12/1970 Wilson ..... 73/151
3,571,937 3/1971 Sears ..... 33/312
3,587,175 6/1971 Armistead ..... 33/312 X
3,789,511 2/1974 Groom et al. ..... 33/312
3,862,499 1/1975 Isham et al. ..... 33/312
4,047,430 9/1977 Angehrn ..... 73/151

*Primary Examiner*—Jerry W. Myracle
*Attorney, Agent, or Firm*—Michael B. McMurry; Ted E. Killingsworth; Harold A. Williamson

[57] ABSTRACT

To provide for accurate determination of azimuth in a borehole survey apparatus, a downhole probe is provided with two or more sections connected by torsionally rigid, flexible joint assemblies with provisions for generating signals that represent the relative inclination and azimuth of one probe section from another. These signals are combined with inclination signals obtained from a set of accelerometers in one of the probe sections in a signal processing unit to generate signals that represent the direction and depth of the borehole.

35 Claims, 10 Drawing Figures

BOREHOLE SURVEY APPARATUS UTILIZING ACCELEROMETERS AND PROBE JOINT MEASUREMENTS

TECHNICAL FIELD

The invention relates to the field of borehole survey instruments and in particular to borehole survey instruments having probes that utilize inertial reference devices such as accelerometers.

BACKGROUND OF THE INVENTION

Surveying of boreholes, such as those used in geologic surveying, mining and oil well drilling requires an accurate determination of the azimuth and elevation coordinates of the boreholes so that an accurate plot of the direction and depth of the borehole can be made. Surveying of a borehole is often accomplished by an instrument or a probe which moves through the borehole and measures inclination and azimuth angles at successive points. Inclination, the angle by which the borehole deviates from the vertical, may be measured with a pendulum or an accelerometer. Azimuth, the angle of the borehole with respect to reference direction, such as north, is typically measured with a magnetic or gyroscopic compass. These angles, together with the distance along the borehole, are used to determine the coordinates of points along the borehole with respect to a reference on the ground.

Various approaches have been used in surveying boreholes in the past including the use of magnetometers, gyroscopes and accelerometers. For example, a pendulum for measuring inclination may take the form of a linear servoed accelerometer which responds to gravity. Servoed accelerometers are available which are small, rugged and accurate. The accurate measurement of azimuth can be quite difficult, however. For instance, magnetic compasses or other devices for measuring the earth's magnetic field are subject to errors caused by magnetic anomalies in the ground. Gyroscopic compasses also have several drawbacks including large size, bearing wear, sensitivity to shock, drift and precession errors and the requirement for a long settling period for stabilization when a measurement is made. As a result, borehole surveying instruments utilizing gyroscopes tend to be expensive and complicated as well as requiring probes with a large diameter.

An example of another approach is provided in the copending patent application to Liu entitled "Borehole Survey Apparatus and Method", Ser. No. 200,096, filed on Oct. 23, 1980 in which a probe having two sections connected by a torsionally rigid member has an accelerometer package in each probe which are utilized to derive the relative tilt and azimuth angle of the borehole as the probe descends in the borehole. This approach has a significant advantage over prior art methods of borehole surveying in speed and accuracy and the further advantage of not having to utilize a compass for azimuth measurement. In addition, because it utilizes accelerometers, the probe may have a relatively small diameter housing and is substantially more rugged. However, this particular method has as one of its disadvantages the inability to determine azimuth when the direction of the borehole is very close to horizontal.

SUMMARY OF THE INVENTION

It is therefore an object of the invention to provide a borehole surveying apparatus having a probe with a first and a second section adapted for insertion and movement through a borehole with a joint flexibly connecting the first section to the second section along with a device for measuring the angles between the first and second probe sections at the flexible joint wherein the borehole survey apparatus includes a signal processor which is responsive to the angle signals to produce an indication of the borehole direction.

It is a further object of the invention to provide a borehole survey apparatus that includes a probe having a first and second section adapted for insertion and movement through the borehole with a joint for flexibly connecting the first probe section to the second probe section wherein an accelerometer assembly is included in the first probe section and an angle measurement assembly is included to measure the angles between the longitudinal axes of the first probe section and the second probe section. Also included in the survey apparatus is a signal processor for producing from the accelerometer signals a signal representing the inclination of the first probe section in the borehole and for producing from the angle measurement assembly signals representing the inclination of the second probe with respect to the first probe and the azimuth of the second probe with respect to the first probe wherein also included are provisions for producing a horizontal component signal representing the sine of the combination of the inclination angle and the inclination angle of the second probe with respect to the first probe along with producing signals representing the sine and the cosine of the azimuth between the first and the second probe sections. Additionally, the processor is responsive to the horizontal component signal and the cosine of the azimuth signal for producing a horizontal projection representing the incremental horizontal projection of the borehole along a first predetermined direction such as north and means responsive to the horizontal component signal and the sine of the azimuth signal for generating a signal representing the incremental projection of the borehole along a second predetermined direction such as east.

An additional object of the invention is to provide a borehole surveying apparatus that includes a probe having a first and a second section adapted for insertion and movement through a borehole with a joint assembly flexibly connecting the sections together along with a plurality of accelerometers contained within the first probe section and a method of measuring the angle between the first and section probe sections. Also included is a group of signal conditioning circuits connected to the outputs of each of the accelerometers and a multiplexer circuit contained within the probe operatively connected to the angle measurement means and the signal conditioning circuits with an analog to digital converter circuit connected to the output of the multiplexer circuit and a serial converter circuit operatively connected to the output of the analog to digital converter circuit with a data transmission line connected to the output of the serial converter circuit. A logic circuit contained within the probe is connected to the multiplexer circuit, the analog to digital converter circuit and the serial converter circuit and is effective to cause the multiplexer circuit to multiplex the accelerometer output signals and the angle signals and is further effective to cause the analog to digital converter circuit to convert the multiplexed accelerometer output signals and angle signal into digital form with the serial converter circuit effective to apply the digital accelerometer output signals and angle signals to the data transmission cable. A data receiver located outside the borehole is operatively connected to the data transmission cable to receive the digital signals from the probe.

Another object of the invention is to provide a borehole surveying apparatus that includes a probe having a first and a second section with a joint assembly flexibly connecting the sections together along with an angle measurement assembly included within the joint assembly having a group of strain gauges for generating signals representing the angles between the first and second probe sections at the joint assembly.

DETAILED DESCRIPTION OF THE INVENTION

Figure 1:
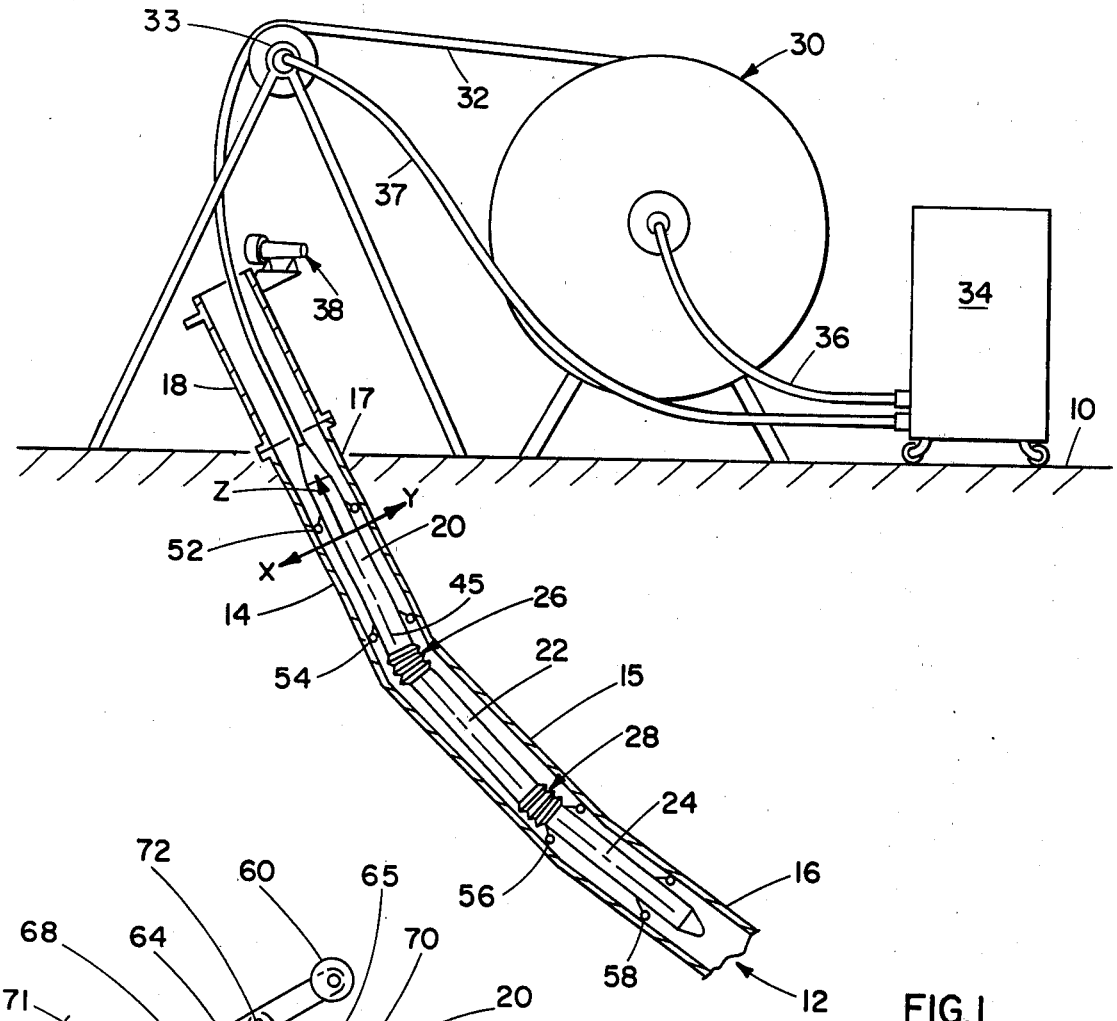
FIG. 1 is an illustration of an apparatus embodying the invention, including a section through a borehole showing a probe used with the borehole surveying apparatus.
Figure 3:
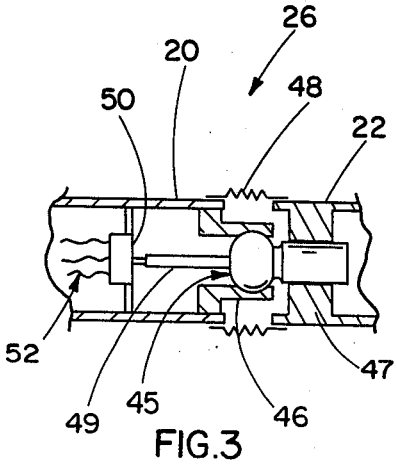
FIG. 3 is a sectioned longitudinal drawing of a joint assembly for connecting two probe sections together.
Figure 5:
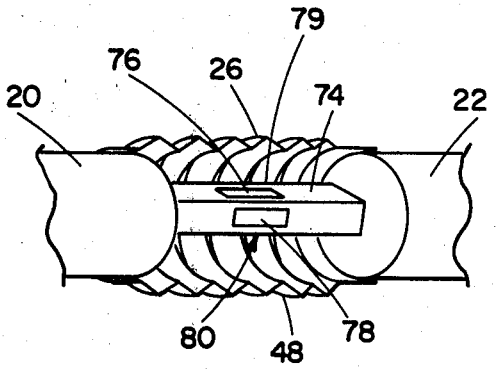
FIG. 5 is a sectioned longitudinal drawing illustrating an alternative joint assembly utilizing a flexible bar including strain gauges.

In FIG. 1 is illustrated a representative environment for the preferred embodiment of the invention. Extending below the ground 10 is a borehole generally indicated at 12 that is lined with a plurality of borehole casings 14, 15 and 16 as is the general practice in industry. At the point 17 where the borehole 12 enters the ground 10 is a launch tube 18 that is connected to the first borehole casing 14. Inserted into the borehole 12 for movement through the borehole is a probe that includes three probe sections 20, 22 and 24 that are connected by torsionally rigid, flexible joint assemblies 26 and 28. Examples of joint assemblies that are suitable for use with the probe are shown in FIGS. 3 and 5. The first probe section 20 is connected to a cable reel 30 by means of a cable 32 that runs over an above ground pully 33. The cable 32 serves to lower the probe through the borehole 12 and additionally provides a transmission medium for transmitting data from the probe to a signal processor 34 over a cable 36 from the reel 30. Another signal transmission line 37 is connected between the pully 33 and the signal processor 34 to provide an indication of the amount of cable 32 that is paid out into the borehole 12. Attached to the launch tube 18 is a transit 38 that can be used for determining the initial azimuth of the borehole with respect to a direction such as north. In addition, the initial tilt angle or inclination angle of the borehole from vertical as indicated by the launching tube 18 can be determined by conventional level devices that may be attached to the transit 38.

Figure 2:
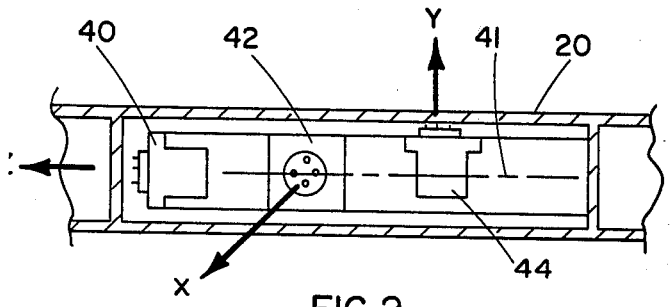
FIG. 2 is a partial sectioned longitudinal drawing of a probe section illustrating an arrangement of accelerometers in the probe.

As shown in FIG. 2, secured within the first probe section 20 is a triaxial accelerometer package including three accelerometers 40, 42 and 44. A suitable accelerometer for this application is a linear servoed accelerometer of the type disclosed in U.S. Pat. No. 3,702,073. The first accelerometer 40 is located within the first probe section 20 with its sensitive axis or z axis located along the longitudinal axis 41 of the probe section 20 and the other two accelerometers 42 and 44 are located with their sensitive axes x and y at right angles to the z axis and at right angles to each other. As a result, when the first probe section 20 is suspended in the vertical direction, the z axis will be perpendicular with respect to the horizon and the x and y axes will be parallel to the horizon.

In FIG. 3 is illustrated in sectioned form the embodiment of the flexible joint assembly 26 which includes a ball 45 and a socket 46 arrangement for connecting the first probe section 20 to the second probe section 22 in order to permit the second probe section 22 to flex angularly with respect to the first probe section 20. The ball 45 is secured to the housing of probe section 22 by a support member 47. Also included are bellows 48 that, in addition to facilitating the flexing of the probe section 22 with respect to the probe section 20, prevent the probe section 22 from rotating with respect to probe section 20 so that the probe sections 20 and 22 are torsionally rigid with respect to each other. Also included in the flexible joint assembly 26 is a joystick type potentiometer 50 that includes a rod 49 attached to the ball 45 resulting in voltage signals on lines 52 representing the direction and magnitude of the angular flexing of the second probe section 22 with respect to the first probe section 20.

In order to improve the accuracy of the signals generated by the accelerometers 40, 42 and 44 in the first probe section 20 and the signals generated by the flexible joint assemblies 26 and 28, the upper probe section 20 and the lower probe section 24 are provided with centralizer mechanisms 52, 54, 56 and 58 in order to retain the probe sections 20 in the center of the borehole casings as shown at 14 and 16. A detailed example of a mechanism for the centralizers 52, 54, 56 and 58 is shown in the sectioned drawing of FIG. 4. Included in the centralizer mechanism are two rollers 60 and 62 that are adapted for rolling along the inside of the borehole casings 14 and 16. The rollers 60 and 62 are extended on a pair of legs 63 and 64 from the housing of the probe 20 by means of a mechanism including extender bars 65 and 66 under pressure from an extender spring 67. The extender bars 65 and 66 are attached to a telescoping support bar 68 at a pivot 70. The other end of the telescoping support bar 68 and the legs 63 and 64 are pivotally attached to a support base 71. Extender bars 65 and 66 are attached to the legs 63 and 64 pivots 72 and 73. However, in the preferred embodiment of the invention, the centralizer mechanism would include three or more rollers located on legs spaced equally apart in order to retain the probe 20 within the center of the borehole casing. The mechanism in FIG. 4 is shown with only two legs for ease of understanding.

Figure 4:
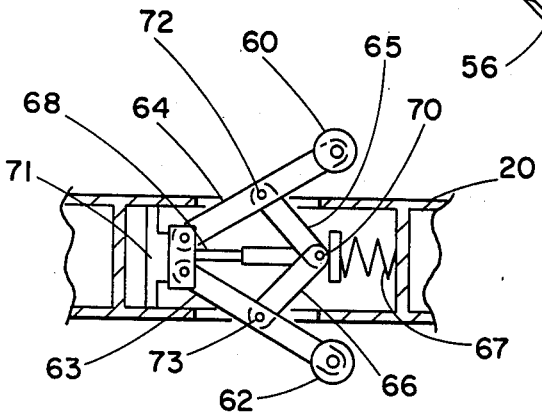
FIG. 4 is a sectioned longitudinal drawing of a centralizer mechanism for use with the probe.

Since each centralizer leg 63 and 64 as shown in FIG. 4 must extend an equal distance from the probe section as the other legs, the probe will be located exactly along the center line of the borehole thereby providing the centralizer mechanism as shown in FIG. 4 with a significant accuracy advantage over centralizers using independently sprung rollers. The extender spring 67 can be configured such that the forces acting on any leg are overcome by the spring. Thus the weight of the probe section 20 or the force of the cable 32 cannot move the prove from the center of the borehole. If the extender spring 67 does not have sufficient strength to overcome the forces acting on the rollers, then the forces can overcome the spring and one leg will separate from the side wall of the borehole 12 decentering the probe. With independent springs, even the slightest force will decenter the probe by some amount as well as causing some oscillations fo the probe to and from the center line when the force is removed. This problem will not occur where the legs work in unison and the spring is configured so that it is larger than the sum of the forces acting on any one leg.

Figure 6:
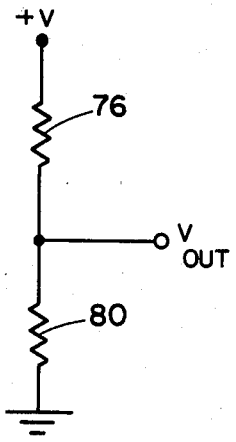
FIG. 6 is a schematic diagram of a circuit to be used with the strain gauge arrangement shown in FIG. 5.

An alternative to the mechanism shown in FIG. 3 for measuring the angles between two of the probe sections is illustrated in FIG. 5. In this angular readout mechanism, a member 74 configured as a square flexible bar is secured to each of the probe sections 20 and 22. On each face of the bar is a semiconductor strain gauge here indicated at 76, 78, 79 and 80. Two strain gauges on the far side of the flexible bar 74 are not visible in FIG. 5, but their relative locations are indicated by references 79 and 80. Semiconductor strain gauges have a significant advantage over metal strain gauges in this application since a large signal can be generated for small angular deflections, for example of two and one-half degrees or less, since the gauge factor for a semiconductor strain gauge is 150 versus 2 for metal strain gauges. By electrically connecting a pair of strain gauges on opposite faces such as strain gauges 76 and 80 in a half bridge circuit arrangement as shown in FIG. 6, a voltage signal is generated that represents the angular deflection of one probe section with respect to the other. The other pair of strain gauges on the bar 74 will be connected in a similar manner. As shown in the schematic diagram of FIG. 6, one strain gauge 76 is connected to a voltage supply and the strain gauge 80 on the opposite face of the flexible bar 74 is connected in series with the strain gauge 76 with a voltage output reading $V_{out}$ connected between. In this arrangement, only a differential change due to angular deflection between probe sections 20 and 24 will produce an output voltage $V_{out}$. Cross axis bending will cancel out since the strain gauges 76 and 80 on opposite faces will generate the same cross bending signals. In addition, this connection will compensate for temperature effects and common mode bar stretching or compression. It will be understood that in this arrangement the flexible member 74 will replace the ball and socket arrangement as shown in FIG. 3 to mechanically connect the first probe section 20 with the second probe section 22.

Figure 7:
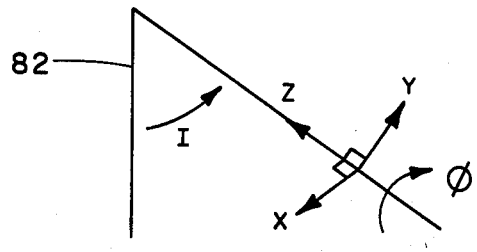
FIG. 7 is a geometric diagram representing the orientation of the accelerometers in a probe section.
Figure 8:
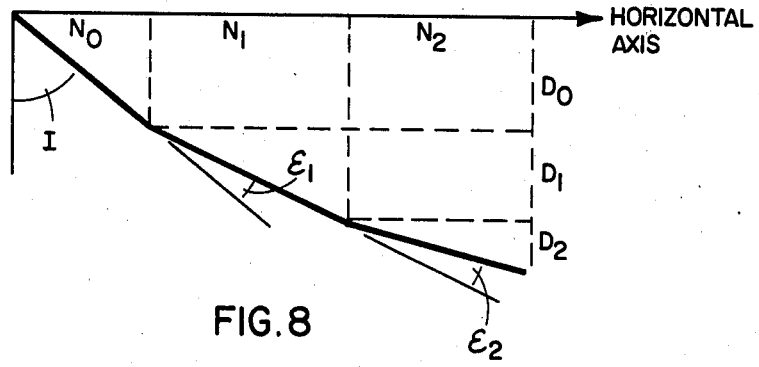
FIG. 8 is a geometric diagram illustrating the vertical orientation of the borehole surveying apparatus with respect to ground or the horizontal axis.
Figure 9:
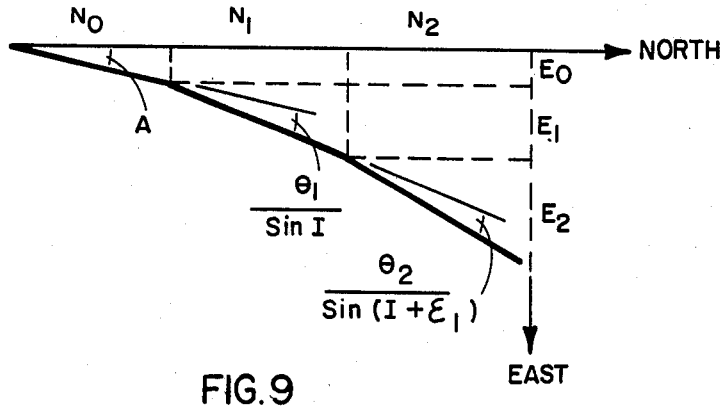
FIG. 9 is a geometric diagram illustrating the horizontal orientation of the borehole surveying apparatus with respect to azimuth.

In defining the geometrical relationships of the borehole 12 and the output signals from the accelerometers 40, 42 and 44 along with the angle signals from the angle joints 26 and 28, reference should be made to the geometrical diagrams as shown in FIGS. 7, 8 and 9. The definition of the joint angles $\epsilon$ and $\theta$ are with respect to the accelerometer axes x, y and z with $\epsilon$ defined as a vertical angle change with respect to the y axis, assuming that the y axis is in the plane defined by the z axis and true vertical as indicated by the line 82 in FIG. 7. Similarly the $\theta$ angles are defined with respect to the x axis assuming the x axis is horizontal. The $\epsilon$ angles and the horizontal projections of the $\theta$ angles can be considered relative inclination and azimuth angles respectively since they represent relative changes in inclination and azimuth of one probe section with respect to another probe section. The probe roll angle $\phi$ as illustrated in FIG. 7 represents the rotation of the probe sections 20, 22 and 24 in the borehole 12 as illustrated in FIG. 7. In this embodiment of the invention, the probe angles $\epsilon$ and $\theta$ are measured from the previous probe section and are direct measurements of the angles between two probe sections such as probe section 20 and probe section 22. In Table I below are defined the various symbols used in the definition of the description of this invention.

TABLE I

| |
|---|
| A—Azimuth angle from north (0° = north, 90° = east, 180° = south, 270° = west) |
| I—Inclination from vertical (0° = straight down, 90° = horizontal) |
| $\epsilon$—Probe joint angle change in inclination (vertical plane) |
| $\theta$—Probe joint angle change in the xz plane |
| $\phi$—Probe roll angle (about the z-axis) |
| N—North compass heading (true north) |
| E—East compass heading |
| D—Depth vertically |
| L—Length of probe sections |
| C—Length of cable paid out |
| x—Probe horizontal component (normal to z) |
| y—Probe vertical component (normal to z) |
| z—Probe longitudinal component (tangent to bore hole axis) |
| $a_x$—x Accelerometer output (along x-axis when $\phi = 0°$) |
| $a_y$—y Accelerometer output (along y-axis when $\phi = 0°$) |
| $a_z$—z Accelerometer output along z-axis |
| $P_{x1}$—Potentiometer output proportional to angle along x accelerometer at first joint |
| $P_{x2}$—Potentiometer output proportional to angle along x accelerometer at second joint |
| $P_{y1}$—Potentiometer output proportional to angle along y accelerometer at first joint |
| $P_{y2}$—Potentiometer output proportional to angle along y accelerometer at second joint |

Equation (1) below defines the inclination angle I in terms of the accelerometer outputs $a_x$, $a_y$ and $a_z$.

$$I = \tan^{-1}\left(\frac{\sqrt{a_x^2 + a_y^2}}{a_z}\right) \quad (1)$$

Since in this embodiment of the invention probe roll angle $\phi$ is not mechanically controlled in the borehole, the vertical component of gravity normal to the probe longitudinal axis will be a combination of the x and y accelerometer measurements. If the x accelerometer 40 were horizontal, then I will be equal to $\tan^{-1}(a_y/a_z)$ as will be apparent from the illustration in FIG. 7. Equation (1) defines I in the general case.

A transformation of the accelerometer outputs and the angle outputs to surface coordinates is described first with respect to the simple case where azimuth A is equal to $\theta_1$ and $\theta_2$ which in turn is equal to zero. As can be seen from FIG. 8 the horizontal projection of the probe on the ground, assuming the ground is level, can be broken into three segments, one for each probe section. The horizontal components of each probe $N_o$, $N_1$ and $N_2$ are:

$$N_o = L_o \sin I \quad (2)$$
$$N_1 = L_1 \sin (I + \epsilon_1) \quad (3)$$
$$N_2 = L_2 \sin (I + \epsilon_1 + \epsilon_2) \quad (4)$$

Equations (2), (3) and (4) above can be considered horizontal projections because they represent the projections of the probe sections 20, 22 and 24 on the ground.

By the same token the depth projection of each of the probe sections can be represented as:

$$D_o = L_o \cos I \quad (5)$$
$$D_1 = L_1 \cos (I + \epsilon_1) \quad (6)$$
$$D_2 = L_2 \cos (I + \epsilon_1 + \epsilon_2) \quad (7)$$

For the general case where the azimuth angle A is not equal to zero, the heading length N of the probe as a whole is modified by the cosine of the azimuth angle A in the following manner:

$$N_i = N_o \cos A + N_1 \cos\left(A + \frac{\theta_1}{\sin I}\right) + N_2 \cos\left(A + \frac{\theta_1}{\sin I} + \frac{\theta_2}{\sin(I + \epsilon_1)}\right) \quad (8)$$

or $$N_1 = L_o \sin I \cos A + L_1 \sin (I + \epsilon_1) \cos\left(A + \frac{\theta_1}{\sin I}\right) + L_2 \sin (I + \epsilon_1 + \epsilon_2) \cos\left(A + \frac{\theta_1}{\sin I} + \frac{\theta_2}{\sin(I + \epsilon_1)}\right) \quad (9)$$

where $N_i$ is the "ith" measurement in a series of measurements as the probe is advanced through the borehole in integral multiples of the probe length. It should be noted in Equations (8) and (9) above that $\theta_1$ is divided by the sine of I and $\theta_2$ is divided by the sine of I plus $\epsilon_1$. This is to compensate for the effects of inclination on the azimuth readings as illustrated in FIG. 9.

A measurement of the east heading E or azimuth is provided by equation 10 below:

$$E_i = L_o \sin I \sin A + L_1 \sin (I + \epsilon_1) \sin\left(A + \frac{\theta_1}{\sin I}\right) + L_2 \sin (I + \epsilon_1 + \epsilon_2) \sin\left(A + \frac{\theta_1}{\sin I} + \frac{\theta_2}{\sin(I + \epsilon_1)}\right)$$

The heading measurements in Equations (9) and (10) result from direct readings of the instruments in the probe for each probe length advancement down the borehole and it is possible to provide for more probe sections by just adding additional terms to the above equations.

The operation of the borehole survey apparatus is described in terms of the first measurement being made with the the first probe section 20 starting in the launch tube 18 as illustrated in FIG. 1 of the drawings. Each subsequent measurement or readings from the accelerometers and angle joints is made after the probe has advanced by two-thirds of the overall probe length such that the first section 20 containing the accelerometers 40, 42 and 44 will occupy the same section of the borehole pipe that the third probe section 24 occupied on the previous measurement.

Computation of the azimuth angles $\theta_1$ and $\epsilon_2$ can be summed with the previously measured angles without skipping a measurement. Equations (11), (12), (13) and (14) below represent the computation of the increments of the projection of the probe sections 20, 22 and 24 in a north heading and east heading as well as depth and length of cable paid out when the probe is in the launch tube 18.

$$N_1 = L_o \sin I_1 \cos A_1 + L_1 \sin (I_1 + \epsilon_1) \cos\left(A_1 + \frac{\theta_1}{\sin I}\right) + L_2 \sin (I_1 + \epsilon_1 + \epsilon_2) \cos\left(A_1 + \frac{\theta_1}{\sin I} + \frac{\theta_2}{\sin(I + \epsilon_1)}\right) \quad (11)$$

$$E_1 = L_o \sin I_1 \sin A_1 + L_1 \sin (I_1 + \epsilon_1) \sin\left(A_1 + \frac{\theta_1}{\sin I}\right) + L_2 \sin (I_1 + \epsilon_1 + \epsilon_2) \sin\left(A_1 + \frac{\theta_1}{\sin I} + \frac{\theta_2}{\sin(I + \epsilon_1)}\right) \quad (12)$$

$$D_1 = L_o \cos I_1 + L_1 \cos (I_1 + \epsilon_1) + L_2 \cos (I_1 + \epsilon_1 + \epsilon_2) \quad (13)$$

$$C_1 = L_o + L_1 + L_2 \quad (14)$$

The next step in the process for surveying the borehole is to advance the probe down the borehole by two-thirds of its length such that the first probe section 20 is in the same position that the third section 24 was in the previous measurement. The azimuth angle for the second measurement is then defined by Equation (15) below:

$$A_2 = A_1 + \frac{\theta_1}{\sin I} + \frac{\theta_2}{\sin(I + \epsilon_1)} \quad (15)$$

Since the accelerometers 40, 42 and 44 contained within the first probe section 20 can be used to make a direct measurement of inclination I, it is not necessary to compute $I_2 = I_1 + \epsilon_1 + \epsilon_2$ but it may be done in order to furnish an additional check on accuracy. The next increment of the probes movement under ground through the borehole is computed by means of the formulas (16), (17), (18) and (19) below:

$$N_2 = N_1 + L_1 \sin (I_2 + \epsilon_1) \cos\left(A_2 + \frac{\theta_1}{\sin I}\right) + L_2 \sin (I_2 + \epsilon_1 + \epsilon_2) \cos\left(A_2 + \frac{\theta_1}{\sin I} + \frac{\theta_2}{\sin(I + \epsilon_1)}\right) \quad (16)$$

$$E_2 = E_1 + L_1 \sin (I_2 + \epsilon_1) \sin\left(A_2 + \frac{\theta_1}{\sin I}\right) + L_2 \sin (I_2 + \epsilon_1 + \epsilon_2) \sin\left(A_2 + \frac{\theta_1}{\sin I} + \frac{\theta_2}{\sin(I + \epsilon_1)}\right) \quad (17)$$

-continued $$D_2 = D_1 + L_1 \cos(I_2 + \epsilon_1) + L_2 \cos(I_2 + \epsilon_1 + \epsilon_2) \quad (18)$$

$$C_2 = C_1 + L_1 + L_2 \quad (19)$$

For the third measurement, azimuth angle $A_3$ is again defined by Equation (20) as:

$$A_3 = A_2 + \frac{\theta_1}{\sin I} + \frac{\theta_2}{\sin(I + \epsilon_1)} \quad (20)$$

and the third increment of probe travel through the borehole is computed by using Equations (21), (22), (23) and (24) as indicated below:

$$N_3 = N_2 + L_1 \sin(I_3 + \epsilon_1) \cos\left(A_3 + \frac{\theta_1}{\sin I}\right) + L_2 \sin(I_3 + \epsilon_1 + \epsilon_2) \cos\left(A_3 + \frac{\theta_1}{\sin I} + \frac{\theta_2}{\sin(I + \epsilon_1)}\right) \quad (21)$$

$$E_3 = E_2 + L_1 \sin(I_3 + \epsilon_1) \sin\left(A_3 + \frac{\theta_1}{\sin I}\right) + L_2 \sin(I_3 + \epsilon_1 + \epsilon_2) \sin\left(A_3 + \frac{\theta_1}{\sin I} + \frac{\theta_2}{\sin(I + \epsilon_1)}\right) \quad (22)$$

$$D_3 = D_2 + L_1 \cos(I_3 + \epsilon_1) + L_2 \cos(I_3 + \epsilon_1 + \epsilon_2) \quad (23)$$

$$C_3 = C_2 + L_1 + L_2 \quad (24)$$

The general form for each step of the borehole measurement procedure is defined by equations (25), (26), (27) and (28) below:

$$N_i = N_{i-1} + L_1 \sin(I_i + \epsilon_1) \cos\left(A_i + \frac{\theta_1}{\sin I}\right) + L_2 \sin(I_i + \epsilon_1 + \epsilon_2) \cos\left(A_i + \frac{\theta_1}{\sin I} + \frac{\theta_2}{\sin(I + \epsilon_1)}\right) - L_o \sin I_1 \cos A_1 \quad (25)$$

$$E_i = E_{i-1} + L_1 \sin(I_i + \epsilon_1) \sin\left(A_i + \frac{\theta_1}{\sin I}\right) + L_2 \sin(I_i + \epsilon_1 + \epsilon_2) \sin\left(A_i + \frac{\theta_1}{\sin I} + \frac{\theta_2}{\sin(I + \epsilon_1)}\right) - L_o \sin I_1 \sin A_1 \quad (26)$$

$$D_i = D_{i-1} + L_1 \cos(I_i + \epsilon_1) + L_2 \cos(I_i + \epsilon_1 + \epsilon_2) - L_o \cos I_1 \quad (27)$$

$$C_i = C_{i-1} + L_1 + L_2 - L_o \quad (28)$$

The above example of borehole surveying was described without taking into account possible rotation of the probe within the borehole as defined by the angle $\phi$. Probe roll angle $\phi$ can be determined from the x accelerometer 42 and the y accelerometer 44 in the first probe section 20 by means of the following relation:

$$\phi = \tan^{-1}\left(\frac{a_x}{a_y}\right) \quad (29)$$

The actual value of $\phi$ in degrees will depend upon the polarity of the outputs of the x accelerometer 42 and the y accelerometer 44 according to Table II below:

TABLE II

| Polarity $a_x$ | Polarity $a_y$ | Condition | Equation | $\phi$ Range |
|---|---|---|---|---|
| ± | + | $\lvert a_x\rvert \leqq \lvert a_y\rvert$ | $\phi = \tan^{-1}\left(\frac{a_x}{a_y}\right)$ | $-45° \leqq \phi \leqq 45°$ |
| + | + | $\lvert a_x\rvert \geqq \lvert a_y\rvert$ | $\phi = 90° - \tan^{-1}\left(\frac{a_y}{a_x}\right)$ | $45° \leqq \phi \leqq 90°$ |
| − | + | $\lvert a_x\rvert \geqq \lvert a_y\rvert$ | $\phi = -90° - \tan^{-1}\left(\frac{a_y}{a_x}\right)$ | $-90° \leqq \phi \leqq -45°$ |
| + | − | $\lvert a_x\rvert \leqq \lvert a_y\rvert$ | $\phi = 180° + \tan^{-1}\left(\frac{a_x}{a_y}\right)$ | $135° \leqq \phi \leqq 180°$ |
| − | − | $\lvert a_x\rvert \leqq \lvert a_y\rvert$ | $\phi = -180° + \tan^{-1}\left(\frac{a_x}{a_y}\right)$ | $-180° \leqq \phi \leqq -135°$ |
| + | − | $\lvert a_x\rvert \geqq \lvert a_y\rvert$ | $\phi = 90° - \tan^{-1}\left(\frac{a_y}{a_x}\right)$ | $90° \leqq \phi \leqq 180°$ |
| − | − | $\lvert a_x\rvert \geqq \lvert a_y\rvert$ | $\phi = -90° - \tan^{-1}\left(\frac{a_y}{a_x}\right)$ | $-180° \leqq \phi \leqq -90°$ |

After determining the probe roll angle $\phi$ utilizing the relations shown in Table II, the angle outputs of the joint assemblies can be compensated for roll angle so that the probe joint angle change in the inclination and the probe joint angle change in azimuth $\epsilon$ and $\theta$ respectively represent actual inclination and azimuth changes. This is accomplished using the relations provided in Equations (30) and (31) below:

$$\theta_i = P_{xi} \cos\phi - P_{yi} \sin\phi \quad (30)$$

$$\epsilon_i = P_{yi} \cos\phi + P_{xi} \sin\phi \quad (31)$$

Operation of the borehole surveying apparatus as described above assumes that the probe started at the top of the borehole, however, the method of operation as described above could equally be used when the probe is dropped to the bottom of the borehole and the survey proceeds from the bottom to the top. However in this case it would be necessary to compute the actual values for $N_i$, $E_i$ and $D_i$ after the probe reached the launch tube so that the initial starting azimuth angle $A_o$ could be determined.

Figure 10:
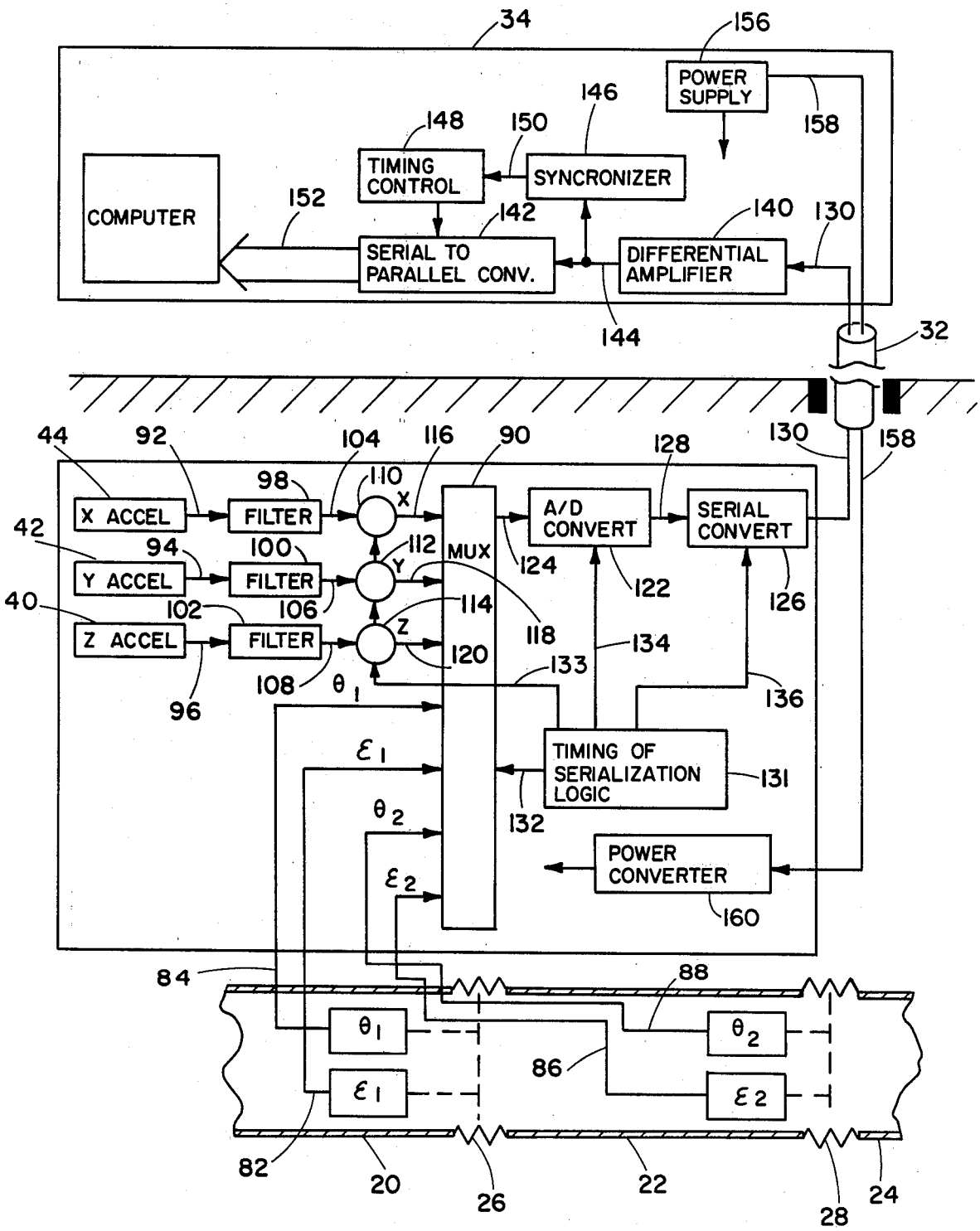
FIG. 10 is a block diagram of a signal processing system for processing the signals from the probe into a representation of borehole direction including inclination and azimuth.

In FIG. 10 is illustrated in block diagram form a signal processing system for generating signals representing the direction of the borehole from accelerometers 40, 42 and 44 and the angle signals $\epsilon_1$ and $\epsilon_2$ and $\theta_1$ and $\theta_2$ from the joint assemblies 26 and 28. As shown in FIG. 10, the angle signals $\epsilon_1$, $\epsilon_2$, $\theta_1$ and $\theta_2$ are transmitted over lines 82, 84, 86 and 88 to a multiplexer circuit 90. Accelerometer output signals $a_x$, $a_y$ and $a_z$ are transmitted over lines 92, 94 and 96 to filter circuits 98, 100 and 102 respectively. The outputs of the filter circuits 98, 100 and 102 are then applied over lines 104, 106 and 108 to sample and hold circuits 110, 112 and 114 which in turn are connected to the multiplexer 90 by means of lines 116, 118 and 120. The output of the multiplexer 90 is applied to an analog to digital converter circuit 122 by means of lines 124 and the resulting digital output of the analog to digital converter 122 is transmitted to a serial converter circuit 126 by means of line 128. Connected to the output of the serial converter circuit 126 is a data transmission cable 130 which forms a part of the cable 32 shown in FIG. 1. In the preferred embodiment of the invention, the various circuit elements described above including the filter circuits 98, 100 and 102, the sample and hold circuits 110, 112 and 114, the multiplexer circuit 90, the analog to digital converter circuit 122 and the serial converter circuit 126 are contained within the probe. As with the accelerometers 42, 40 and 44, these circuit elements may be contained within the first probe section 20.

In addition to the above described circuit elements, a timing and logic circuit 131 is included in the first probe section 20 and is operatively connected by means of lines 132, 133, 134 and 136 to the multiplexer 90, the sample and hold circuits 110, 112 and 114, A/D circuit 128 and the serial converter circuit 126. The logic circuit 131 is effective to cause the multiplexer circuit 90 to multiplex the outputs of the sample and hold circuits 110, 112 and 114 such that the filtered output of the accelerometers 40, 42 and 44 is applied to the multiplexer 90. The logic signals from the logic circuit 131 are applied to the sample and hold circuits 110, 112 and 114 over line 138. Multiplexed signals from the multiplexer 90 are then converted by the analog to digital converter circuit 122 to a digital format and then are converted by the serial converter circuit to a serial bit stream that is transmitted over line 130 to the data receiver 34.

A differential amplifier 140 receives the serial bit stream representing the accelerometer and angle signal outputs from the data transmission line 130 and applies this bit stream to a serial to parallel converter circuit 142 by means of line 144. A synchronizer circuit 146 in combination with a timing and control circuit 148 by means of a line 150 is effective to cause the serial to parallel converter 142 to convert the serial bit stream into a parallel signal on lines 152. The digital data on lines 152 is then applied to a computer, that can be either an analog or digital to generate signals that represent the direction of the borehole according to the relations described in the foregoing specification.

The signal processor 34 also includes a power supply 156 which provides power for the various components of the probe over a power transmission line 158 and the components of the signal processor 34. The power transmission line 158 also forms a part of the cable 32 shown in FIG. 1 and transmits power to a power converter circuit 160 in the probe which provides power to the various circuit components and instruments such as the accelerometers 40, 42 and 44 contained within the various sections of the probe.

The assumption that the probe advances or rises in increments of precisely two-thirds of the probe length need not be a rigid operational requirement. Intermittent measurements with shorter increments or asynchronous measurements with the probe in continuous motion may be easily made provided that the length of the launch tube 18 is at least $2L_o$, and that the computation algorithm incorporates some sort of interpolation scheme. One suitable method is that disclosed by Liu in his copending patent application Ser. No. 200,096.

We claim:

1. A borehole survey apparatus comprising:

a probe including a first probe section and a second probe section adapted for insertion and movement through a borehole and a joint assembly flexibly connecting said first probe section to said second probe section;

angle measurement means, operatively connected to said probe, for generating signals representing the angle between said second and said first probe sections at said joint assembly;

signal processing means, responsive to said angle signals, for generating signals representing the direction of the borehole;

means for generating an inclination signal representing the inclination of said first probe section from the verticle direction;

means for combining said angle signals and said inclination signal to generate signals representing the direction of the borehole inclination and azimuth; and means for generating a signal representing the movement of said probe in the borehole and means responsive to said angle signals, said inclination signals and said movement signals for generating a signal representing the depth of the borehole.

2. A borehole survey apparatus comprising:

a probe including a first probe section and a second probe section adapted for insertion and movement through a borehole and a joint assembly flexibly connecting said first probe section to said second probe section;

angle measurement means, operatively connected to said probe, for generating signals representing the angle between said second and said first probe sections at said joint assembly;

signal processing means, responsive to said angle signals, for generating signals representing the direction of the borehole;

means for generating an inclination signal representing the inclination of said first probe section from the vertical direction; and means for generating a first one of said angle signals that represents the relative inclination of said second probe section with respect to said first probe section and second one of said angle signals that represents the relative azimuth of said second probe section with respect to said first probe section;

means for generating from said inclination signal a horizontal component signal representing the sine of the combination of said inclination signal and said relative inclination signal.

3. The apparatus of claim 2 wherein said signal processing means includes means for generating an azimuth sine signal representing the sine of a signal including said relative azimuth signal and an azimuth cosine signal representing the cosine of a signal including said relative azimuth signal.

4. The apparatus of claim 3 wherein said signal processing means includes means for combining said horizontal projection signal with said azimuth cosine signal to generate a signal representing an increment of the horizontal projection of the borehole in a first direction.

5. The apparatus of claim 4 wherein said signal processing means includes means for combining said horizontal projection signal with said azimuth sine signal to generate a signal representing an increment of the horizontal projection of the borehole in a second direction.

6. The apparatus of claim 5 wherein said means for generating said azimuth sine signal and said azimuth cosine signal includes means for generating a signal representing the sine of a signal including at least in part said inclination signal and means for dividing said relative azimuth signal by said inclination sine signal.

7. The apparatus of claim 3, 4, 5, or 6 wherein said joint assembly includes means for preventing the rotation of said first probe section with respect to said second probe section.

8. The apparatus of claim 5, wherein said joint assembly includes means for preventing the rotation of said first probe section with respect to said second probe section.

9. The apparatus of claim 5 wherein said probe additionally includes a third probe section;

means for flexibly connecting said third probe section to said second probe section;

means operatively connected to said probe, for generating signals representing the angle between said third probe section and said second probe section; and wherein said signal processing means additionally includes means for utilizing said signals representing the angle between said first and said second probe sections to generate additional signals representing the direction of the borehole.

10. The apparatus of claim 2 wherein said signal processing means includes means for combining said inclination signal with said relative inclination signal into a combined inclination signal and means for generating a signal representing the cosine of said combined inclination signal that represents an increment of the depth of the borehole.

11. The apparatus of claim 2, 3, 4, 5, 10, 6 or 8 additionally including means operatively connected to said signal processing means for compensating for the roll angle of said probe in the borehole.

12. The apparatus of claim 3, 4, 5, 10, 6 or 8 additionally including means operatively connected to said signal processing means for generating a signal representing the roll angle of said probe in the borehole and means responsive to said roll angle signal and said angle measurement means for compensating said relative inclination signal and relative azimuth signal for roll angle.

13. The apparatus of claim 2, 3, 4, 5, 10, 6 or 8 wherein said means for generating an inclination signal includes a plurality of accelerometers disposed within said first probe section.

14. The apparatus of claim 2, 3, 4, 5, 10, 6 or 8 wherein said angle measurement means includes a plurality of strain gauges responsive to angular deflection of said joint assembly.

15. The apparatus of claim 5, 10, 6 or 8 wherein said probe additionally includes:

a third probe section and means for flexibly connecting said third probe section to said second probe section;

means, operatively connected to said probe, for generating a third angle signal that represents the relative inclination of said third probe section with respect to said second probe section and a fourth angle signal that represents the relative azimuth of said third probe section with respect to said second probe section; and wherein said signal processing means additionally includes:

means for generating from said inclination signal a combined horizontal projection signal representing the sine of a signal including the sum of said inclination signal and said first and said second angle signals;

means for generating a signal representing the sine of a signal including the sum of said second and said fourth angle signals and a signal representing the cosine of a signal including the sum of said second and fourth angle signals;

means for combining said combined horizontal projection signal with said signal representing the cosine of the sum of said second and fourth angle signals to generate a signal representing an addition to said signal representing an increment of horizontal projection of the borehole in said first direction; and means for combining said combined horizontal projection signal with said signal representing the sine of said second and fourth angle signal to generate a signal representing an addition to said signal representing an increment of the horizontal projection of the borehole in said second direction.

16. The apparatus of claim 2 additionally including centralizer means for maintaining said first probe section in the center of the borehole.

17. The apparatus of claim 16 wherein said centralizer means includes a plurality of rollers each attached to a leg and an extender mechanism means operatively connected to said legs for causing said rollers to abut the sides of the borehole and maintaining said first probe section in the center of the borehole.

18. The apparatus of claim 17 wherein said extender mechanism means includes an extender spring secured within said first probe section and an extender bar secured to each of said legs and to said extender spring wherein each of said extender bars is effective in response to said extender spring to cause each of said legs to extend an equal distance from said first probe section.

19. The apparatus of claim 2, additionally including means operatively connected to said signal processing means for generating an inclination signal representing the inclination of said first probe section.

20. The apparatus of claim 2, additionally including means, including a plurality of accelerometers disposed within said first probe section and operatively connected to said signal processing means, for generating a signal representing the inclination of said probe section.

21. A borehole survey apparatus comprising:

a probe including a first probe section having a longitudinal axis and a second probe section having a longitudinal axis and a joint assembly flexibly connecting said first probe section to said second probe section adapted for insertion and movement through a borehole;

an accelerometer assembly including a plurality of accelerometers disposed within said first probe section wherein said accelerometers generate a plurality of signals representing the relative spatial orientation with respect to gravity of said first probe section in the borehole;

angle measurement means, operatively connected to said probe, for generating signals representing the angles between the longitudinal axis of said second probe section and the longitudinal axis of said first probe section;

means operatively connected to said accelerometer assembly, for generating from said accelerometer signals a signal representing the inclination of said first probe section with respect to the direction of gravity;

means, operatively connected to said angle measurement means, for generating from said angle signals a first angle signal that represents the relative inclination of said second probe section longitudinal axis with respect to said first probe section longitudinal axis and a second angle signal that represents the relative azimuth of said second probe section longitudinal axis with respect to said first probe section longitudinal axis;

means, responsive to said inclination signal and said first angle signal, for generating a horizontal component signal representing the sine of the combination of said inclination signal and said first angle signal;

means, operatively connected to said angle measurement means, for generating a signal representing the sine of a signal including said second angle signal and signal representing the cosine of a signal including said second angle signal;

means, responsive to said horizontal component signal and said cosine of the second angle signal, for generating a horizontal projection signal representing an incremental horizontal projection of the borehole along a first predetermined direction; and means, responsive to said horizontal component signal and said sine of the second angle signal, for generating a signal representing an incremental horizontal projection of the borehole along a second predetermined direction.

22. The apparatus of claim 21 additionally including depth determining means operatively connected to said accelerometer assembly and said angle measurement means, for generating a signal representing the depth of the borehole.

23. The apparatus of claim 21 additionally including depth determining means, responsive to said inclination signal and said first angle signal, for generating a signal representing an increment of the borehole depth wherein said depth determining means includes:

means for combining said inclination signal with said first angle signal and means for generating a signal representing the cosine of said combined inclination signal and said first angle signal.

24. The apparatus of claim 21 wherein said means for generating said first and second angle signals includes:

means, operatively connected to said accelerometer assembly, for generating a signal representing the roll angle of said probe in the borehole and means for compensating said first and second angle signals for roll angle.

25. The apparatus of claim 21 additionally including:

a third probe section having a longitudinal axis;

means for flexibly connecting said third probe section to said second probe section;

third probe section angle measuring means, operatively connected to said probe, for generating signals representing the angles between the longitudinal axis of said third probe section and said second probe section;

means operatively connected to said third probe section angle measuring means, for generating a third angle signal that represents the inclination of said third probe section longitudinal axis from said second probe section longitudinal axis and a fourth angle signal that represents the azimuth of said third probe section longitudinal axis with respect to said second probe section longitudinal axis; and means responsive to said inclination signal, said third angle signal and said fourth angle signal for generating a signal representing an incremental horizontal projection corresponding to said third probe section of the borehole along said first predetermined direction and a signal representing an incremental horizontal projection corresponding to said third probe section of the borehole along said second predetermined direction.

26. The apparatus of claim 21, 22, 23, 24 or 25 wherein said joint assembly includes means for preventing the rotation of said first probe section with respect to said second probe section.

27. The apparatus of claim 26 wherein said conditioning circuits include a filter circuit and a sample and hold circuit wherein said sample and hold circuits are operatively connected to said logic circuit.

28. The apparatus of claim 21, 22, 23, 24 or 25 wherein said means for generating said signals representing the sine and cosine of said second angle signal includes means for dividing said second angle signal by the sine of said inclination signal.

29. The apparatus of claim 21, 22, 23, 24 or 25 wherein said accelerometer assembly includes three of said accelerometers.

30. The apparatus of claim 21, 22, 23, 24 or 25 wherein said angle measurement means includes a plurality of semiconductor strain gauges.

31. The apparatus of claim 21, 22, 23, 24 or 25 wherein said angle measurement means includes a plurality of strain gauges responsive to angular deflection of said joint assembly.

32. The apparatus of claim 21 wherein said probe additionally includes centralizer means for maintaining said first probe section in the center of the borehole.

33. The apparatus of claim 32 wherein said centralizer means includes:

a plurality of rollers;

a leg attached to each of said rollers; and an extender mechanism operatively connected to said legs for causing said rollers to abut the sides of the borehole and maintaining said first probe section in the center of the borehole.

34. The apparatus of claim 33 wherein said extender mechanism includes an extender spring secured within said first probe section and an extender bar secured to each of said legs and to said extender spring wherein each of said extender bars is effective in response to said extender spring to cause each of said legs to extend an equal distance from said first probe section.

35. A borehole survey apparatus comprising:

a probe including a first probe section and a second probe section adapted for insertion and movement through a borehole along with a joint assembly flexibly connecting said first probe section to said second probe section;

a plurality of accelerometers disposed within said first probe section;

an angle measurement means operatively connected to said probe for generating signals representing the angles between said first and said second probe sections at said joint assembly;

a plurality of signal conditioning circuits disposed within said probe wherein one of each is operatively connected to each of said accelerometers;

a multiplexer circuit disposed within said probe and operatively connected to said angle measurement means and said signal conditioning circuits;

an analog to digital converter circuit disposed within said probe operatively connected to said multiplexer circuit;

a serial converter circuit disposed within said probe and operatively connected to said analog to digital converter circuit;

a data transmission cable operatively connected to the output of said serial converter circuit;

a logic circuit disposed within said probe and operatively connected to said multiplexer circuit, said analog to digital converter circuit and said serial converter circuit effective to cause said multiplexer circuit to multiplex the output of said signal conditioning circuits with said angle signals, and effective to cause said analog to digital converter circuit to convert the multiplexed signals into a digital signal, and effective to cause said serial converter circuit to apply said digital signal to said data transmission cable; and a data receiver located outside the borehole and operatively connected to said data transmission cable for receiving said digital signal from said probe.

* * * * *